US007444966B2

(12) United States Patent
Fujii et al.

(10) Patent No.: US 7,444,966 B2
(45) Date of Patent: Nov. 4, 2008

(54) VALVE MOVING DEVICE FOR ENGINE

(75) Inventors: Noriaki Fujii, Saitama (JP); Akiyuki Yonekawa, Saitama (JP); Katsunori Nakamura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 104 days.

(21) Appl. No.: 10/557,139

(22) PCT Filed: May 26, 2004

(86) PCT No.: PCT/JP2004/007534

§ 371 (c)(1),
(2), (4) Date: Aug. 17, 2006

(87) PCT Pub. No.: WO2004/109078

PCT Pub. Date: Dec. 16, 2004

(65) Prior Publication Data

US 2007/0028875 A1 Feb. 8, 2007

(30) Foreign Application Priority Data

May 28, 2003 (JP) ..... 2003-151222
May 30, 2003 (JP) ..... 2003-154286
Apr. 22, 2004 (JP) ..... 2004-127167

(51) Int. Cl.
*F01L 1/34* (2006.01)

(52) U.S. Cl. ..... 123/90.16; 123/90.44; 123/345

(58) Field of Classification Search ..... 123/90.15, 123/90.16, 90.17, 90.18, 90.2, 90.27, 90.31, 123/90.39, 90.44, 90.6
See application file for complete search history.

(56) References Cited

U.S. PATENT DOCUMENTS 5,365,895 A * 11/1994 Riley ..... 123/90.16

(Continued)

FOREIGN PATENT DOCUMENTS

GB 1 505 643 3/1978

(Continued)

OTHER PUBLICATIONS

Office Action dated Nov. 7, 2007 of corresponding Canadian Application No. 2,526,183.

(Continued)

*Primary Examiner*—Ching Chang
(74) *Attorney, Agent, or Firm*—Kratz, Quintos & Hanson, LLP

(57) ABSTRACT

An engine valve operating system is provided that includes a variable valve lift mechanism in which, when there is a possibility that the rotational speed of the engine might increase beyond an allowed rotational speed due to a downshift error in a manual transmission, etc., the amount of valve lift is decreased without changing the opening angle of the valve (19). By so doing, the curvature at the top of the curve of lift of the valve (19) is reduced, the inertial force applied to the valve (19) is reduced, and improper movement of the valve (19) can be prevented. Moreover, it is possible to prevent any increase in the intake air volume due to a decrease in the amount of lift of the valve (19), and prevent the effectiveness of engine braking from being degraded, thus enabling the rotational speed of the engine to be decreased and thereby preventing improper movement of the valve (19) from being promoted.

9 Claims, 14 Drawing Sheets

U.S. PATENT DOCUMENTS

| | | | | |
|---|---|---|---|---|
| 5,679,094 | A | 10/1997 | Nakamura et al. | 477/111 |
| 6,481,397 | B2 | 11/2002 | Suzuki | 123/90.16 |

FOREIGN PATENT DOCUMENTS

| | | |
|---|---|---|
| JP | 62-45960 | 2/1987 |
| JP | 63-57306 | 4/1988 |
| JP | 8-232693 | 9/1996 |
| JP | 2001-234771 | 8/2001 |

OTHER PUBLICATIONS

Chinese Office Action dated Nov. 9, 2007.

* cited by examiner

SMALL VALVE LIFT

LARGE VALVE LIFT

VALVE MOVING DEVICE FOR ENGINE

FIELD OF THE INVENTION

The present invention relates to an engine valve operating system that includes a variable valve lift mechanism that varies the amount of valve lift.

BACKGROUND ART

In an engine valve operating mechanism, it is necessary to bias a valve in a valve closing direction with a load generated by a valve spring in order to counteract the inertial force of the valve, which increases in proportion to the square of the rotational speed of the engine. In order to prevent the valve operating mechanism from being damaged due to improper movement of the valve when the rotational speed of the engine exceeds an allowed rotational speed due to a downshift error in a manual transmission, etc., a load that exceeds the valve spring load required for achieving the allowed rotational speed is needed. If the load of the valve spring or the strength of the valve operating mechanism is increased in order to prevent damage to the valve operating mechanism, there is the problem that the weight and the cost will increase.

An engine valve operating system described in Japanese Patent Application Laid-open No. 8-232693 reduces the inertial force of the valve to thereby prevent the occurrence of improper valve movement by increasing the valve opening angle without changing the amount of valve lift.

However, in the above-mentioned conventional arrangement, when the rotational speed of the engine increases and improper movement of the valve is about to occur, in order to decrease the inertial force of the valve, the valve opening angle is increased without changing the amount of valve lift, and although the original desire was to decrease the rotational speed of the engine, since the intake air volume increases, the rotational speed of the engine increases, and there is a possibility that improper movement of the valve might be promoted. Furthermore, when the valve opening angle is increased, since the effectiveness of engine braking deteriorates, there is a possibility of an effective braking effect not being obtained and improper movement of the valve not being suppressed.

DISCLOSURE OF THE INVENTION

The present invention has been achieved under the above-mentioned circumstances, and it is an object thereof to suppress effectively improper movement of a valve when there is a possibility that the rotational speed of the engine might exceed an allowed rotational speed.

In order to accomplish this object, in accordance with a first aspect of the present invention, there is proposed an engine valve operating system that includes a variable valve lift mechanism that varies the amount of lift of a valve, the variable valve lift mechanism decreasing the amount of lift of the valve in a region where improper movement of the valve occurs due to an increase in the rotational speed of the engine, so that the curvature at the top of a lift curve of the valve becomes a curvature at which the improper movement does not occur.

In accordance with this first aspect, since the amount of valve lift is decreased when there is a possibility that the rotational speed of the engine might increase and improper movement of the valve might occur, by reducing the curvature at the top of the valve lift curve so as to decrease the inertial force applied to the valve it is possible to prevent the improper movement of the valve. Moreover, by reducing the amount of valve lift so as to prevent any increase in the intake air volume and prevent the effectiveness of engine braking from being degraded, it is possible to reduce the rotational speed of the engine, thereby preventing improper movement of the valve from being promoted.

Furthermore, in accordance with a second aspect of the present invention, in addition to the first aspect, there is proposed an engine valve operating system wherein the variable valve lift mechanism varies the amount of lift without changing the opening angle of the valve. In accordance with this arrangement, since the valve opening angle does not change when the amount of valve lift is varied, it is possible to suppress any increase in the intake air volume and any decrease in the effectiveness of engine braking, thereby yet more reliably preventing improper movement of the valve. Moreover, since only the amount of valve lift is controlled as a parameter for changing the curvature at the top of the valve lift curve, the controllability is improved.

Moreover, in accordance with a third aspect of the present invention, in addition to the first or second aspect, there is proposed an engine valve operating system wherein, when the improper movement occurs, the variable valve lift mechanism decreases, according to the rotational speed of the engine, the amount of lift down to a value at which occurrence of the improper movement can be suppressed. In accordance with this arrangement, since the occurrence of improper movement is suppressed by decreasing the amount of valve lift according to the rotational speed of the engine, it is possible to appropriately decrease the amount of valve lift, thereby reliably suppressing improper movement of the valve while preventing a rapid change in the output of the engine.

An intake valve 19 of embodiments corresponds to the valve of the present invention.

BRIEF DESCRIPTION OF DRAWINGS

FIG. 1 is a partial vertical sectional view of an engine (sectional view along line 1-1 in FIG. 2), FIG. 2 is a sectional view along line 2-2 in FIG. 1, FIG. 3 is a view from arrowed line 3-3 in FIG. 2, FIG. 4 is a side view of a variable valve lift mechanism, FIG. 5 is a perspective view of the variable valve lift mechanism, FIG. 6 is a view from arrow 6 in FIG.3, FIG. 7 is a sectional view along line 7-7 in FIG. 3, FIGS. 8A and 8B are views for explaining the operation of the variable valve lift mechanism, FIG. 9 is a view showing a valve lift curve, FIG. 10 is a graph showing the relationship of the valve inertial force and the valve spring load with respect to the valve lift, FIG. 11 is an enlarged view of an essential part of FIG. 3, and FIG. 12 is a graph showing the relationship between the rotational angle of a control arm and the rotational angle of a sensor arm.

FIG. 13 is a view, corresponding to FIG. 11, of the second embodiment, and FIG. 14 is a graph showing the relationship between the rotational angle of a control arm and the rotational angle of a sensor arm.

BEST MODE FOR CARRYING OUT THE INVENTION

Figure 1:
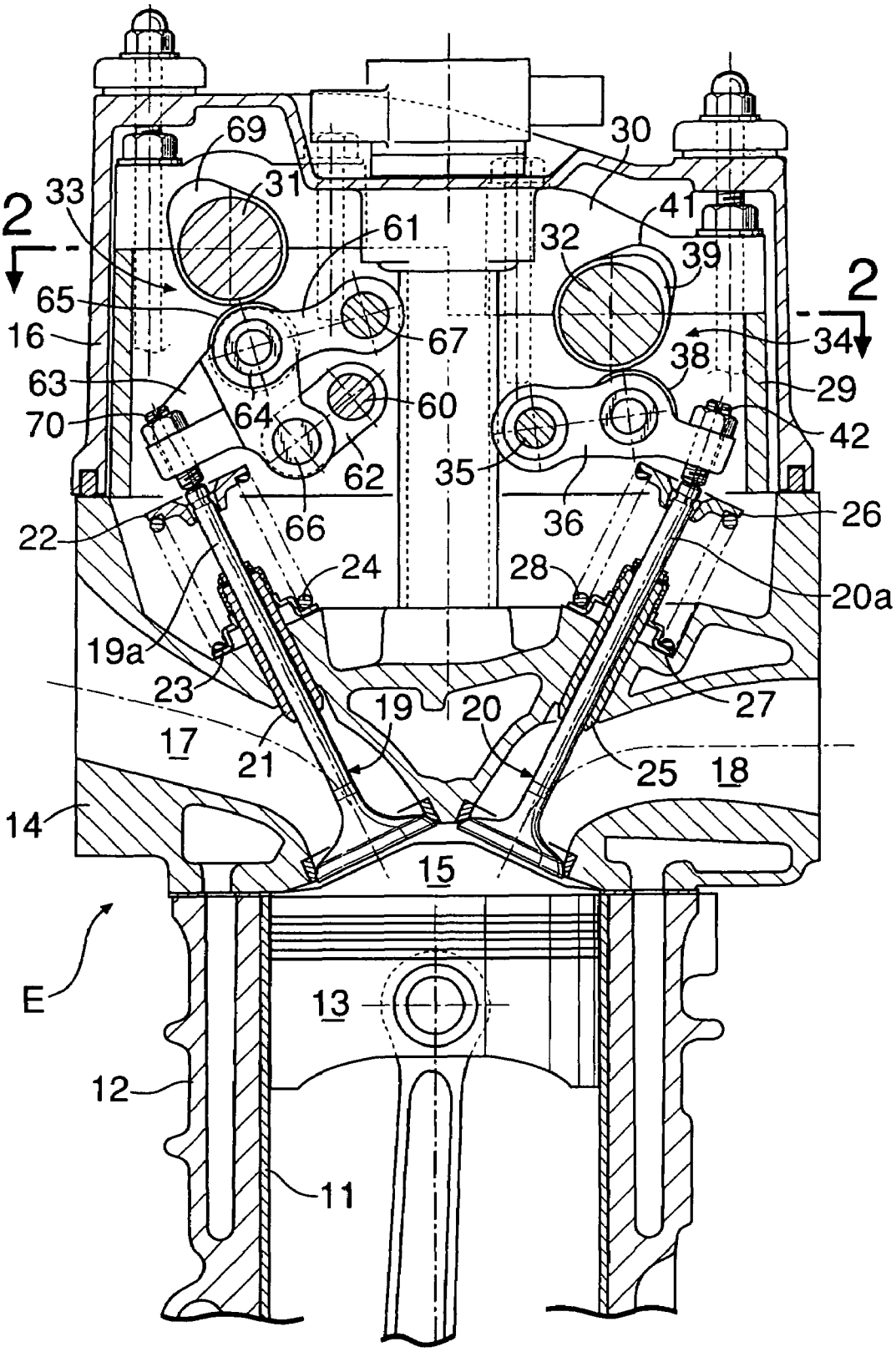
FIG. 1 to FIG. 12 illustrate a first embodiment of the present invention.

A mode for carrying out the present invention is explained below with reference to an embodiment of the present invention shown in attached drawings. As shown in FIG. 1, an in-line multicylinder engine E includes a cylinder block 12 having cylinder bores 11 provided in the interior thereof, pistons 13 slidably fitted in the cylinder bores 11, a cylinder head 14 joined to a top face of the cylinder block 12, combustion chambers 15 formed between the cylinder head 14 and the pistons 13, and a head cover 16 joined to a top face of the cylinder head 14. Formed in the cylinder head 14 are an intake port 17 and an exhaust port 18 each communicating with the combustion chamber 15, the intake port 17 being opened and closed by two intake valves 19, and the exhaust port 18 being opened and closed by two exhaust valves 20. A stem 19*a* of each intake valve 19 is slidably fitted in a valve guide 21 provided in the cylinder head 14, and is biased in a valve closing direction by means of a valve spring 24 disposed between upper and lower spring seats 22 and 23. A stem 20*a* of each exhaust valve 20 is slidably fitted in a valve guide 25 provided in the cylinder head 14, and is biased in a valve closing direction by means of a valve spring 28 disposed between upper and lower spring seats 26 and 27.

Figure 2:
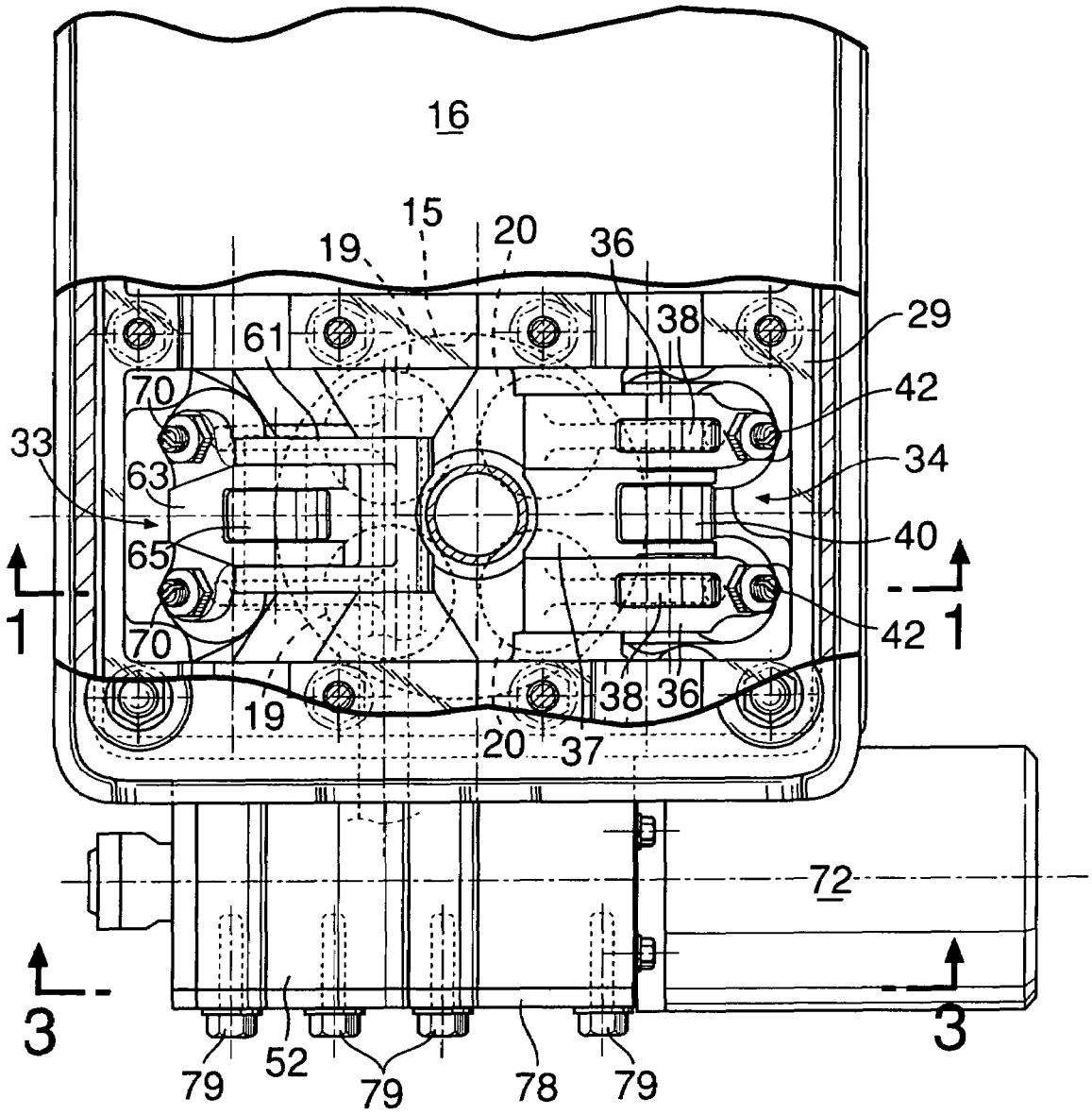

As is clear from FIG. 1 and FIG. 2, an intake camshaft 31 and an exhaust camshaft 32 are rotatably supported between a camshaft holder 29 and a camshaft cap 30 provided in the cylinder head 14. The intake valves 19 are driven by the intake camshaft 31 via a variable valve lift mechanism 33 and the exhaust valves 20 are driven by the exhaust camshaft 32 via a variable valve lift/valve timing mechanism 34.

The variable valve lift/valve timing mechanism 34 that drives the exhaust valves 20 is known, and an outline thereof is explained here. Two low speed rocker arms 36 and one high speed rocker arm 37 are pivotably supported at one end thereof on an exhaust rocker arm shaft 35 supported by the camshaft holder 29, two low speed cams 39 provided on the exhaust camshaft 32 abut against rollers 38 provided in intermediate sections of the low speed rocker arms 36, and a high speed cam 41 provided on the exhaust camshaft 32 abuts against a roller 40 provided in an intermediate section of the high speed rocker arm 37. Adjustment bolts 42 provided at the other ends of the low speed rocker arms 36 abut against stem ends of the exhaust valves 20. When the engine E runs at a low speed, disengaging the connection between the low speed rocker arms 36 and the high speed rocker arm 37 by means of hydraulic pressure allows the low speed rocker arms 36 to be driven by the corresponding low speed cams 39, and as a result the exhaust valves 20 are opened and closed with a low valve lift and a low opening angle. When the engine E runs at a high speed, integrally connecting the low speed rocker arms 36 and the high speed rocker arm 37 by means of hydraulic pressure allows the high speed rocker arm 37 to be driven by the corresponding high speed cam 41, and as a result the exhaust valves 20 are opened and closed with a high valve lift and a high opening angle by means of the low speed rocker arms 36, which are connected to the high speed rocker arm 37. In this way, the valve lift and the valve timing of the exhaust valves 20 are controlled at two levels by the variable valve lift/valve timing mechanism 34.

The structure of the variable valve lift mechanism 33 is now explained with reference to FIG. 3 to FIG. 6. The variable valve lift mechanism 33 includes a bifurcated upper link 61, a lower link 62 that is shorter than the upper link 61, and a rocker arm 63, one end of the upper link 61 and a roller 65 being axially supported in an upper part of the rocker arm 63 via an upper pin 64, and one end of the lower link 62 being axially supported in a lower part of the rocker arm 63 via a lower pin 66. The other end of the upper link 61 is pivotably supported by a rocker arm shaft 67 fixed to the camshaft holder 29, and the other end of the lower link 62 is pivotably supported by a movable support shaft 60. A cam 69 provided on the intake camshaft 31 abuts against the roller 65 axially supported by the upper pin 64, and two adjustment bolts 70 provided on the rocker arm 63 abut against stem ends of the intake valves 19.

The movable support shaft 60 is connected to a crank member 68 that enables the movable support shaft 60 to be angularly displaced around an axis parallel to the axis of the movable support shaft 60, and the crank member 68 is rotatably supported by the camshaft holder 29 of the cylinder head 14 on opposite sides of the rocker arm 63.

The crank member 68 is a single member that is shared by a plurality of cylinders arranged in line and supported by each of the camshaft holders 29, and is formed in a crank shape having, for each cylinder, webs 68*a* disposed on opposite sides of the rocker arm 63, journal portions 68*b* each connected at right angles to the outer face of a base portion of each of the two webs 68*a* and rotatably supported by the camshaft holders 29, and a connecting portion 68*c* providing a connection between the two webs 68*a*, the movable support shaft 60 being connected to the crank member 68 so as to provide a connection between the two webs 68*a*.

In this way, the crank member 68, which is connected to the movable support shaft 60 so that the movable support shaft 60 can be angularly displaced around the axis that is parallel to the axis of the movable support shaft 60, has a two point support structure in which the crank member 68 is supported by the camshaft holders 29 on opposite sides of the rocker arm 63, thereby increasing the rigidity with which the crank member 68 is supported and enabling variable control of the amount of valve lift of the intake valves 20 to be carried out precisely.

Furthermore, since the single crank member 68 is shared by the plurality of cylinders arranged in line and is supported by each camshaft holder 29, it is possible to prevent any increase in the number of components, thereby enabling the dimensions of the engine E to be made compact.

Moreover, since the crank member 68 is formed in the crank shape having the webs 68*a* disposed on opposite sides of the rocker arm 63, the journal portions 68*b* connected at right angles to the outer face of the base portion of each of the two webs 68*a* and rotatably supported by the camshaft holders 29, and the connecting portion 68*c* providing a connection between the two webs 68*a*, and the movable support shaft 60 is connected to the crank member 68 so as to provide a connection between the two webs 68*a*, it is possible to increase the rigidity of the angularly displaced crank member 68, and ensure that hardly any twist torque is applied to the movable support shaft 60, and by press-fitting the movable support shaft 60 into connecting holes 59 of the webs 68*a* in a state in which a movable support shaft through hole 62*a* of the lower link 62 and the connecting holes 59 are aligned with each other, it is possible to easily mount the crank member 68 on the lower link 62 via the movable support shaft 60.

Figure 4:
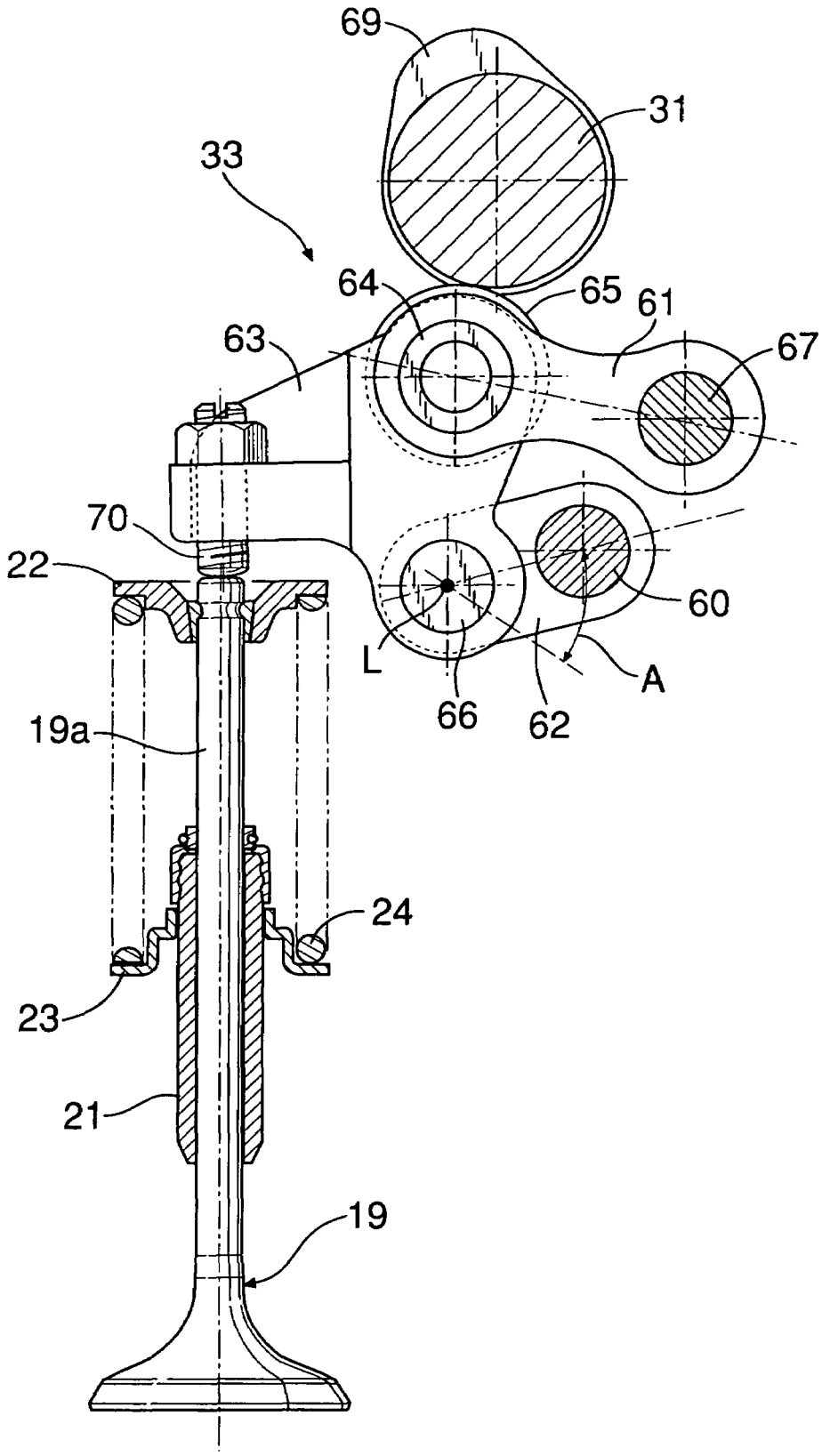
Figure 5:
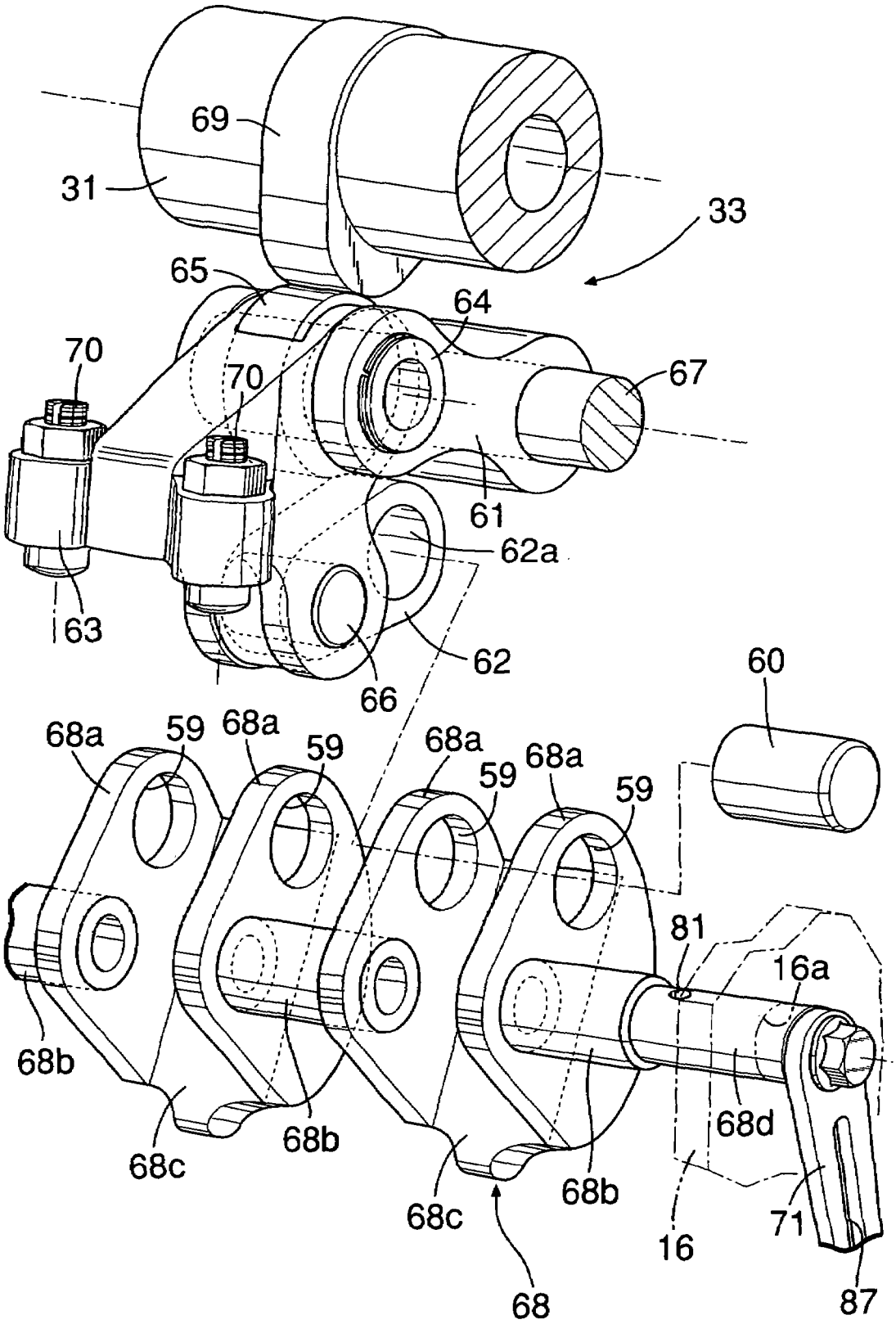
Figure 6:
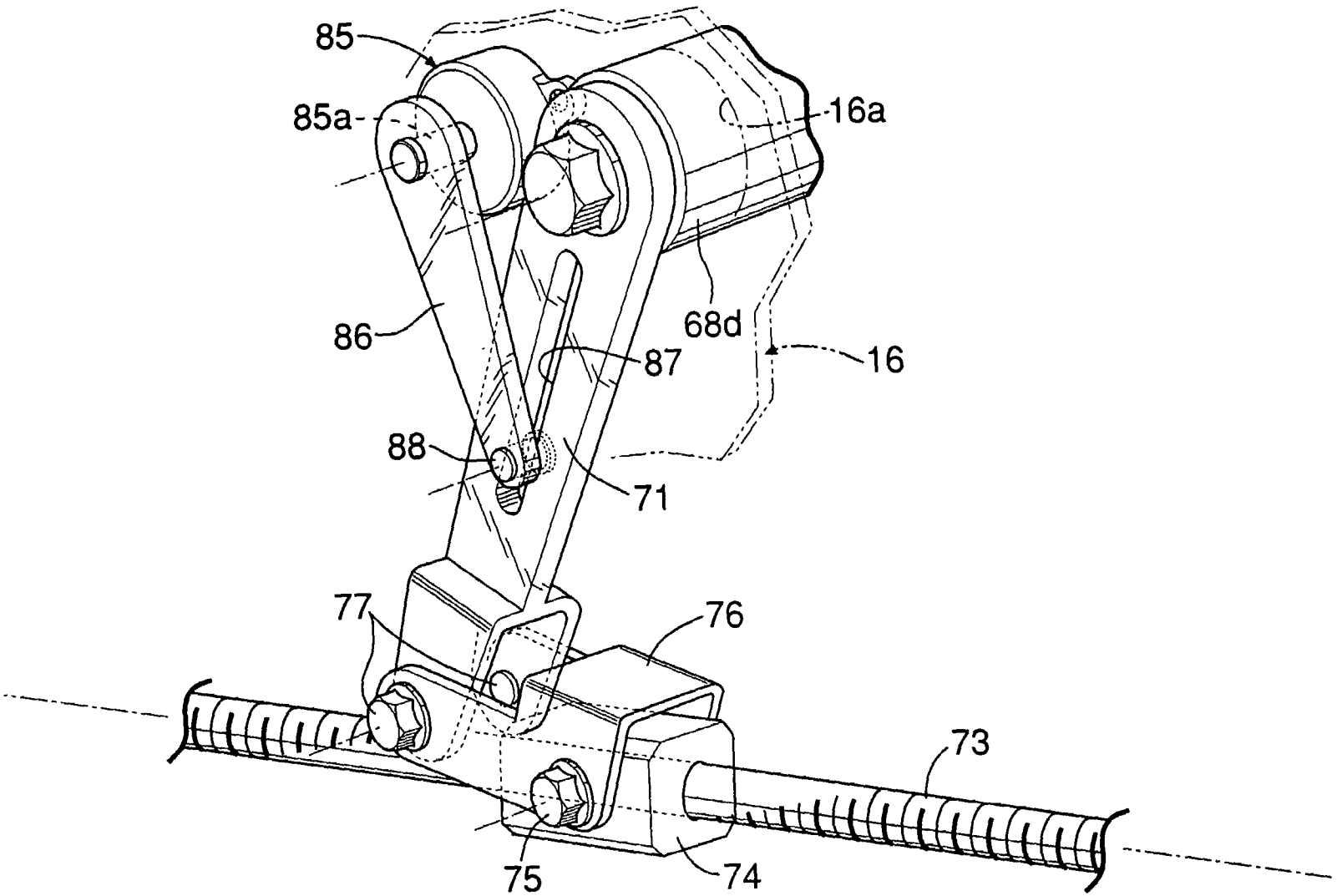

When the rocker arm 63 is at the raised position shown in FIG. 4, that is, the intake valves 19 are in a closed state, the journal portions 68*b* of the crank member 68 are disposed coaxially with an axis L of the lower pin 66, which pivotably supports the lower part of the rocker arm 63. Therefore, when the crank member 68 swings around the axis of the journal portions 68*b*, the movable support shaft 60 moves on an arc A (see FIG. 4) having the journal portion 68*b* as its center.

Figure 7:
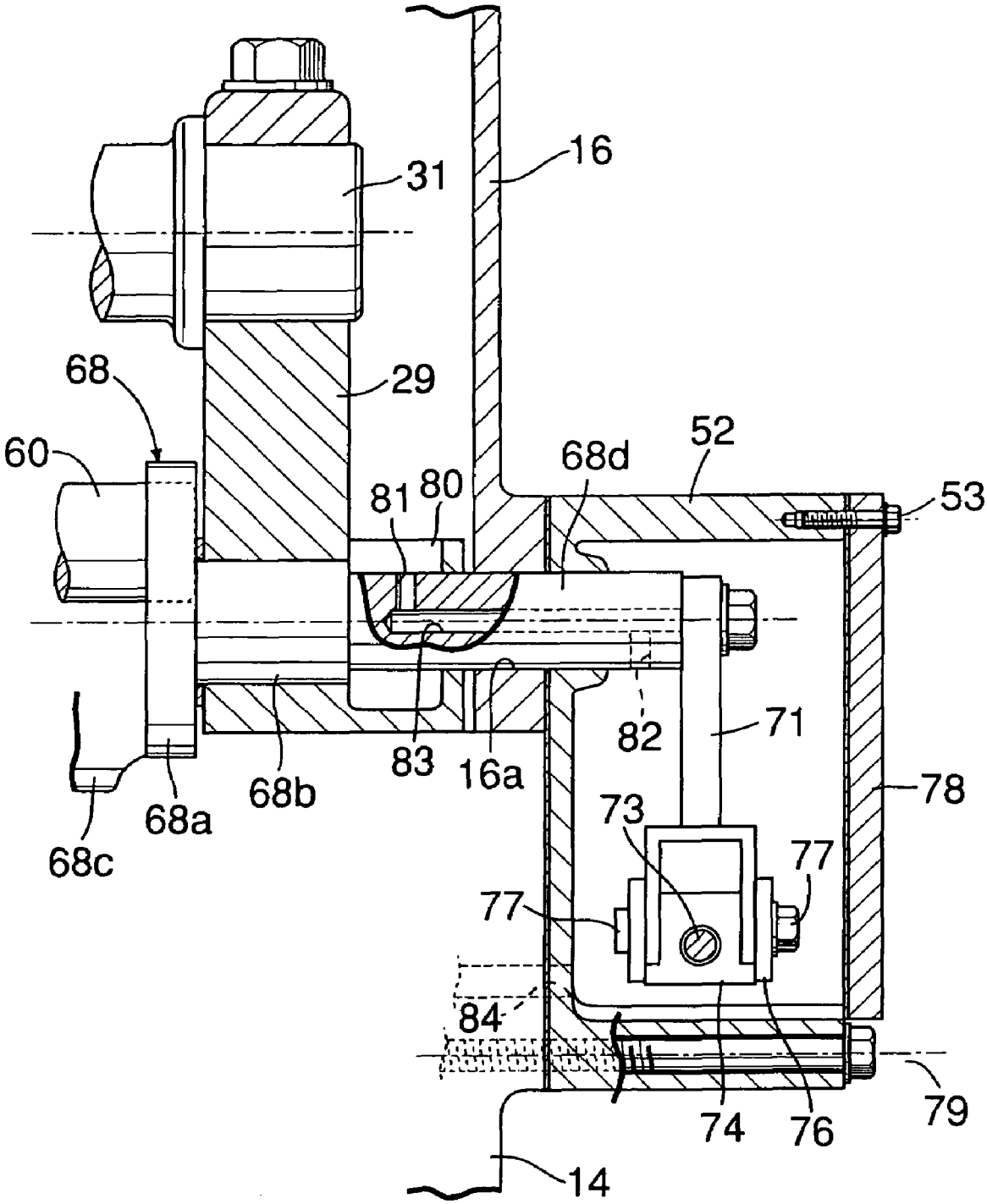

Referring also to FIG. 7, coaxially and integrally connected to the journal portion 68*b* at one end in the axial direction of the crank member 68 is a connecting shaft portion 68*d*, which projects from a support hole 16*a* formed in the head cover 16. A control arm 71 is fixed to the extremity of the connecting shaft portion 68*d*, and this control arm 71 is driven by an actuator motor 72 provided on an outer wall of the cylinder head 14. That is, a nut member 74 meshes with a threaded shaft 73 that is rotated by the actuator motor 72, one end of a connecting link 76 is pivotably supported on the nut member 74 via a pin 75, and the other end thereof is pivotably supported on the control arm 71 via pins 77. When the actuator motor 72 is operated, the nut member 74 therefore moves along the threaded shaft 73, which is rotated, the crank member 68 is made to swing around the journal portion 68*b* by means of the control arm 71 connected to the nut member 74 via the connecting link 76, and the movable support shaft 60 accordingly moves between the position shown in FIG. 8A and the position shown in FIG. 8B.

The threaded shaft 73, the nut member 74, the pin 75, the connecting link 76, the pins 77, and the control arm 71 are housed inside a box-shaped casing 52 that is secured to outer faces of the cylinder head 14 and the head cover 16 via bolts 79. An opening of the casing 52 is covered by a cover member 78 that is detachably fixed via bolts 53, and simply removing the cover member 78 enables the threaded shaft 73, the nut member 74, the pin 75, the connecting link 76, the pins 77, and the control arm 71 to be easily serviced. Moreover, the casing 52 is joined so as to straddle the cylinder head 14 and the head cover 16, thereby enabling the casing 52, the cylinder head 14, and the head cover 16 to increase each other's rigidity. Fixing the actuator motor 72 to the casing 52 also enables the rigidity with which the actuator motor 72 is supported to be enhanced.

Figure 3:
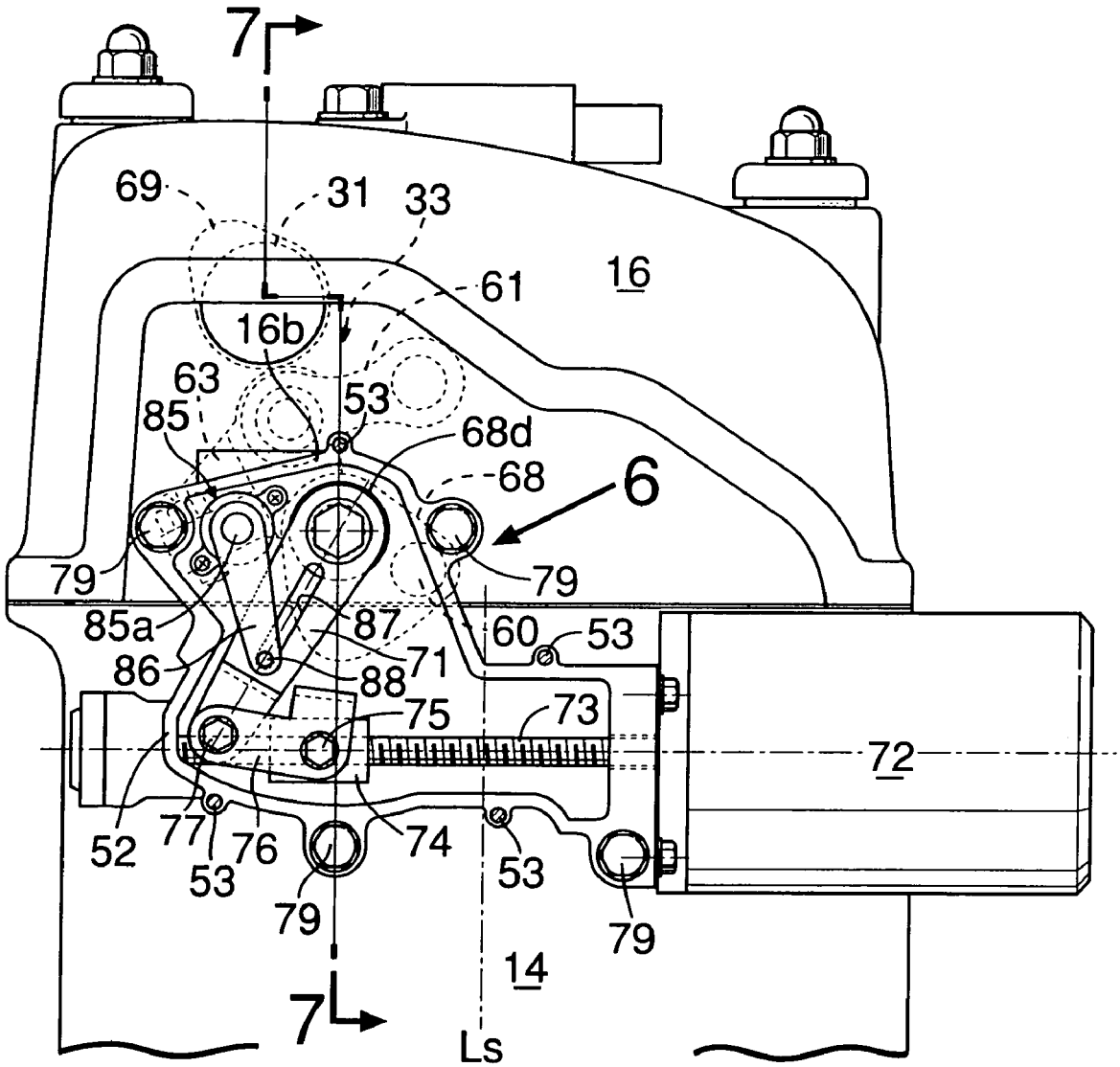

As is clear from FIG. 3, the control arm 71 and the threaded shaft 73 are disposed on the intake valve 19 side (the left-hand side in the figure) relative to a cylinder axis Ls, and the actuator motor 72 is disposed on the exhaust valve 20 side (the right-hand side in the figure). In this way, disposing the control arm 71 and the threaded shaft 73 separately from the actuator motor 72, with them on opposite sides of the cylinder axis Ls, minimizes the extent to which the actuator motor 72 protrudes outward from the cylinder head 14 or the head cover 16, thereby enabling the dimensions to be made compact.

In particular, since the threaded shaft 73 and the actuator motor 72, which are connected in line, are disposed on the cylinder head 14 side relative to the connecting shaft portion 68*d* to which one end of the control arm 71 is connected, while having their axes perpendicular to the cylinder axis Ls, the actuator motor 72 is disposed within the confines of the cylinder head 14, making it yet more compact, and the strong cylinder head 14 enables the rigidity with which the actuator motor 72 is supported to be yet further enhanced.

The casing 52 is secured to the cylinder head 14 and the head cover 16 via four bolts 79; among these bolts 79, two bolts 79 are disposed side-by-side in a direction perpendicular to the cylinder axis Ls on opposite sides of the connecting shaft portion 68*d*, and of the two bolts 79 on the cylinder head 14 side, one is disposed beneath the connecting shaft portion 68*d* along the cylinder axis Ls, and the other bolt 79 is disposed adjacent to the actuator motor 72.

In accordance with such an arrangement of the bolts 79, since the casing 52 is fixed to the head cover 16 via the two bolts 79 on opposite sides of the connecting shaft portion 68*d*, around which the control arm 71 swings with a small amount of travel, and on the threaded shaft 73 side where the control arm 71 swings to a larger extent the casing 51 is fixed to the cylinder head 14 via the bolts 79 beneath the threaded shaft 73, the bolts 79 can be arranged compactly while increasing the rigidity with which the casing 52 is supported.

Although when the casing 52 is mounted so as to straddle the cylinder head 14 and the head cover 16, the bolts 79 might be some distance away from the threaded shaft 73 or the actuator motor 72, since the threaded shaft 73 and the actuator motor 72 are supported on the cylinder head 14 side so as to be perpendicular to the cylinder axis Ls, the bolts 79 and the threaded shaft 73 can be arranged as close to the actuator motor 72 as possible.

Referring to FIG. 7, provided on the camshaft holder 29, which supports the journal portions 68*b* disposed at one end in the axial direction of the crank member 68, is an oil reservoir 80 facing the connecting shaft portion 68*d*, which is coaxially connected to the journal portion 68*b*, and provided in the connecting shaft portion 68*d* are a radial hole 81 whose outer end opens on an outer face of the connecting shaft portion 68*d* so as to communicate with the interior of the oil reservoir 80, a radial hole 82 whose outer end opens on the outer face of the connecting shaft portion 68*d* so as to communicate with the interior of the casing 52, and an axial hole 83 providing a connection between the inner ends of the two radial holes 81 and 82. Also provided in the casing 52 and the cylinder head 14 is a return hole 84 through which oil collected in a lower part within the casing 52 is returned to the interior of the cylinder head 14.

Therefore, oil splashed within the head cover 16 or oil leaking from a bearing portion of the intake camshaft 31 is collected in the oil reservoir 80, and when the connecting shaft portion 68*d* is submerged below the oil level of the oil reservoir 80, the oil within the oil reservoir 80 drops within the casing 52 via the radial hole 81, the axial hole 83, and the radial hole 82. Meshed sections of the threaded shaft 73 and the nut member 74 are thereby lubricated, and the oil that has dropped to the bottom within the casing 52 is returned to the cylinder head 14 side via the return hole 84.

Referring in particular to FIG. 3, the casing 52 is equipped with a rotational angle sensor 85 such as, for example, a rotary encoder, and one end of a sensor arm 86 is fixed to the extremity of a sensor shaft 85*a* of the rotational angle sensor 85. A guide channel 87 is provided in the control arm 71 along its longitudinal direction, and a pin 87 is slidably fitted in the guide channel 87, the pin 87 being provided at the other end of the sensor arm 86.

The operation of this embodiment is now explained. When the control arm 71 is made to swing to the right-hand side of FIG. 3 by means of the actuator motor 72, the crank member 68 (see FIG. 5) connected to the control arm 71 rotates in an anticlockwise direction; as shown in FIG. 8A the movable support shaft 60 ascends, and the shape of a four-joint link joining the rocker arm shaft 67, the upper pin 64, the lower pin 66, and the movable support shaft 60 becomes substantially triangular. When the cam 69 provided on the intake camshaft 31 pushes the roller 65 in this state, the four-joint link deforms, the rocker arm 63 swings downward from the broken line position to the solid line position, and the adjustment bolts 70 push the stem ends of the intake valves 19, thus opening them with a high valve lift.

Figure 8B:
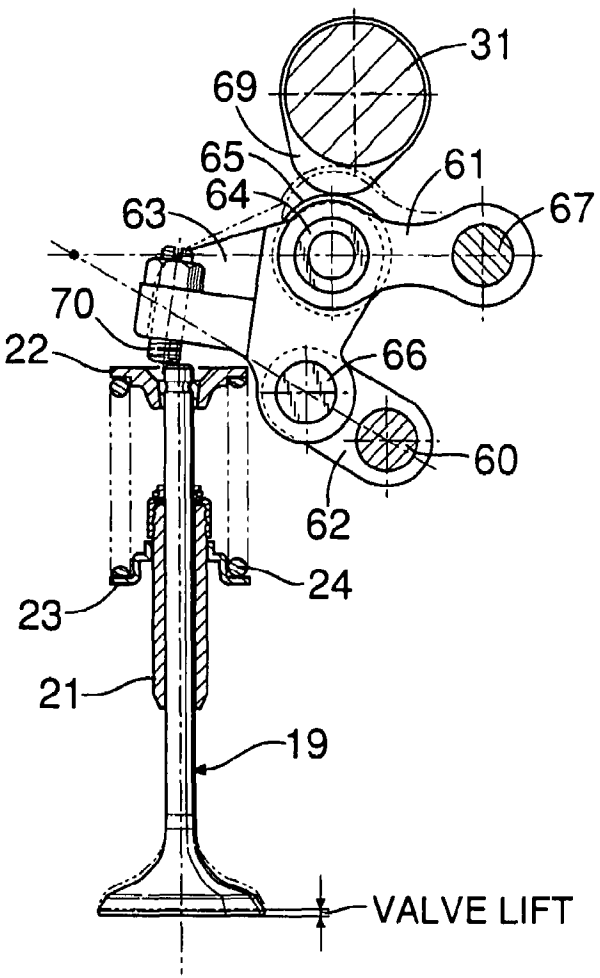
Figure 8A:
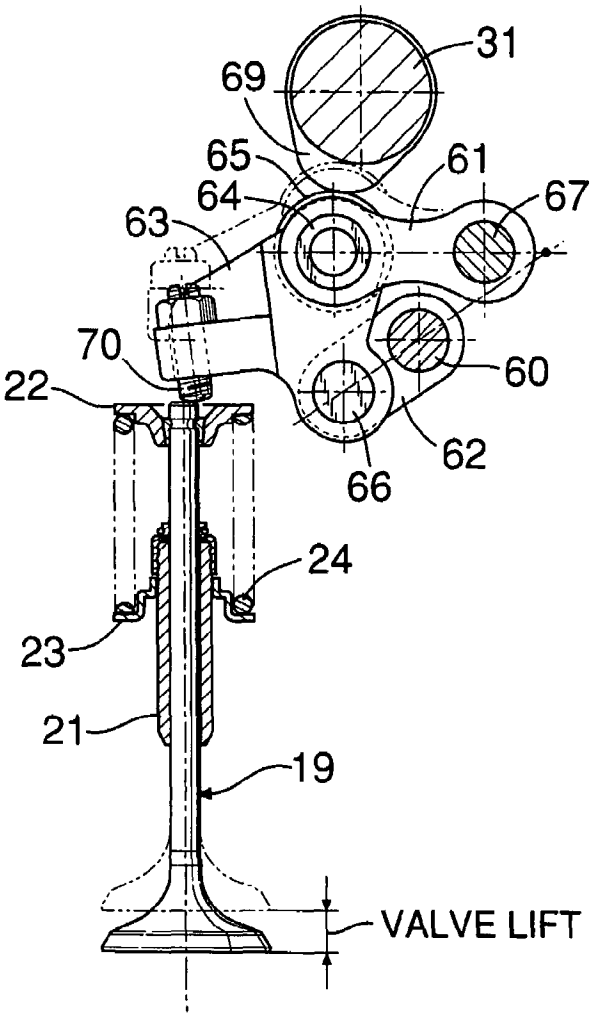

When the control arm 71 is made to swing to the left-hand side of FIG. 3 by the actuator motor 72, the crank member 68 connected to the control arm 71 pivots in a clockwise direction, the movable support shaft 60 descends as shown in FIG. 8B, and the shape of the four-joint link joining the rocker arm shaft 67, the upper pin 64, the lower pin 66, and the movable support shaft 60 becomes substantially trapezoidal. When the cam 69 provided on the intake camshaft 31 pushes the roller 65 in this state, the four-joint link deforms, the rocker arm 63 accordingly swings downward from the broken line position to the solid line position, and the adjustment bolts 70 push the stem ends of the intake valves 19, thereby opening them with a low valve lift.

Figure 9:
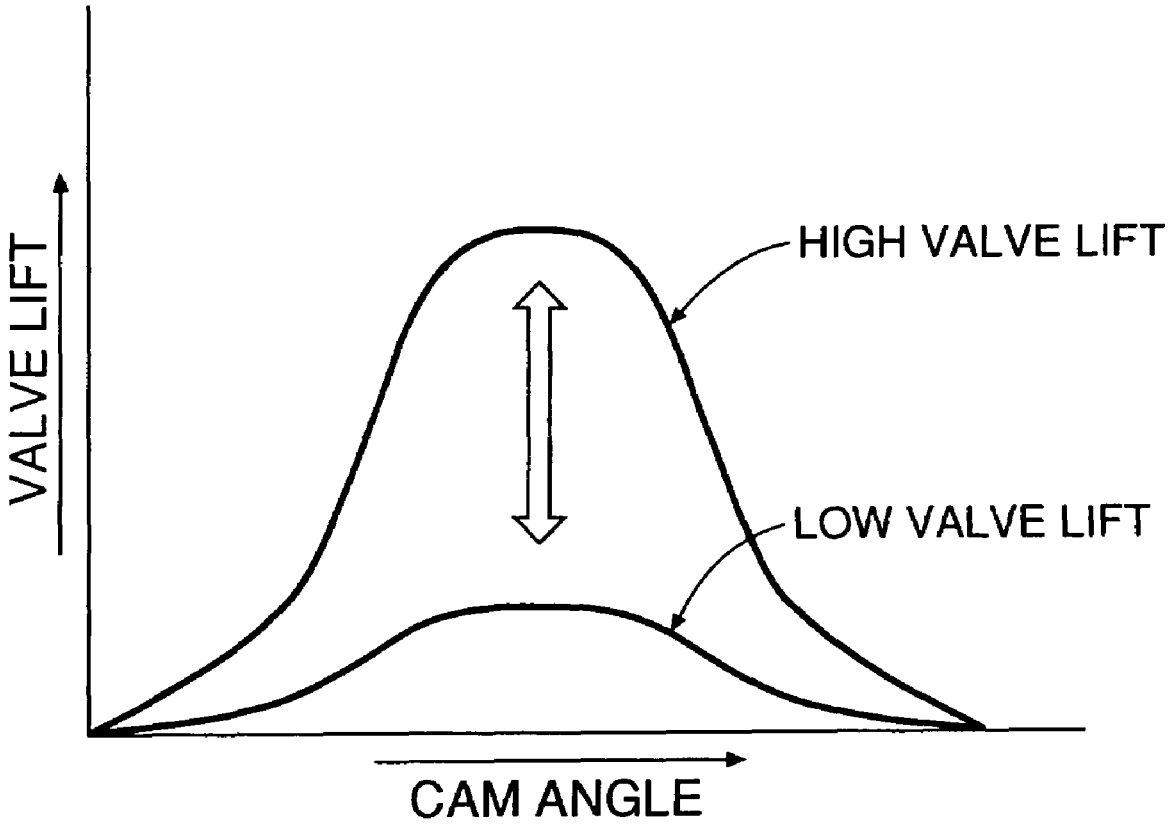

FIG. 9 shows valve lift curves for the intake valves 19; the opening angle with the high valve lift corresponding to FIG. 8A is the same as the opening angle with the low valve lift corresponding to FIG. 8B, and only the amount of valve lift has changed.

When the rotational speed of the engine increases beyond an allowed rotational speed, the opening and closing speed of the intake valves 19 increases, the load of the valve springs 24 becomes insufficient, and a state is produced in which the intake valves 19 are not seated reliably.

Figure 10:
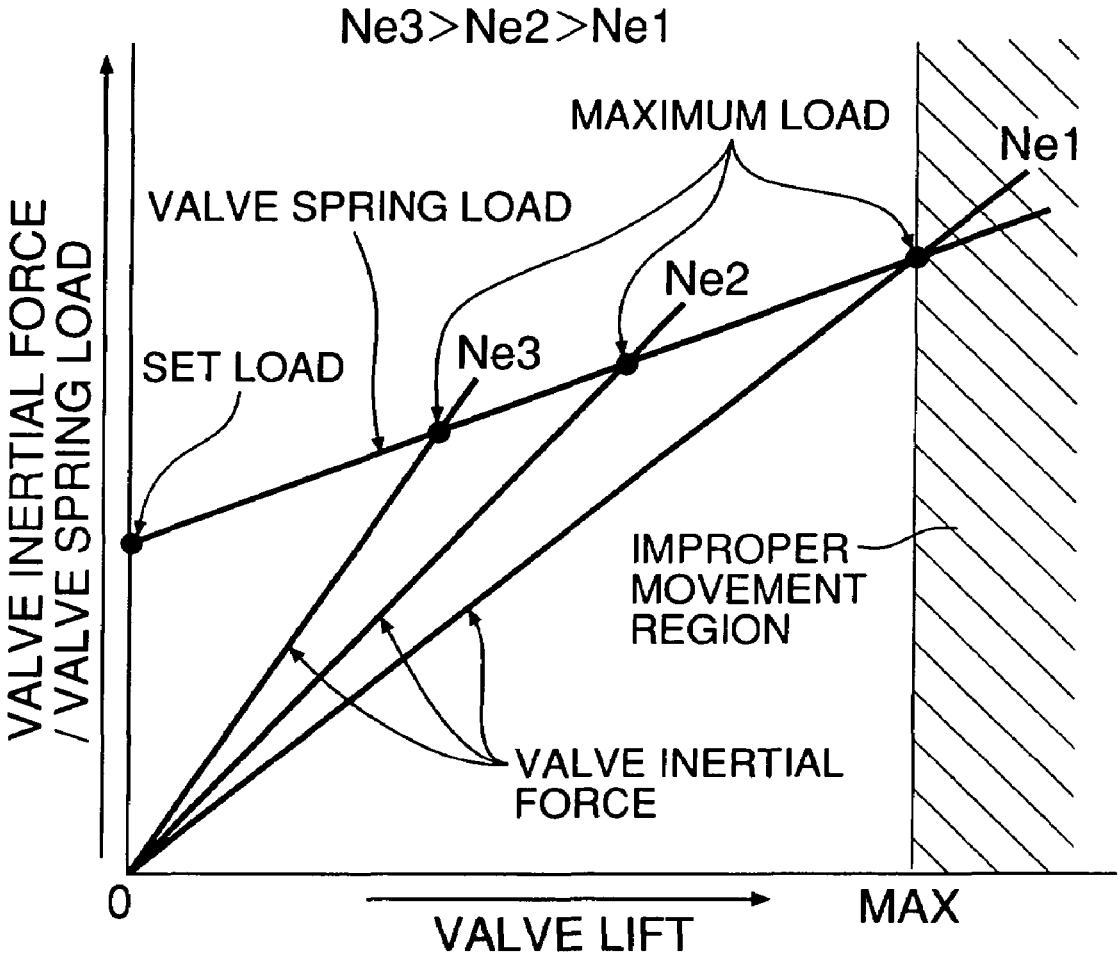

The graph of FIG. 10 shows the relationship between the valve inertial force and the valve spring load with respect to the amount of valve lift at the maximum allowed rotational speed of the engine, and the valve inertial force increases in proportion to an increase in the amount of valve lift whereas the valve spring load increases from a predetermined set load in response to an increase in the amount of valve lift. In order to prevent improper movement of the valve, it is necessary to restrict the amount of valve lift so that the valve spring load exceeds the valve inertial force. The smaller the amount of valve lift, the larger the margin of the valve spring load over the valve inertial force, and even when the rotational speed of the engine increases, improper movement of the valve, that is, valve seating failure, is prevented.

When the rotational speed of the engine increases from Ne1 to Ne2 and then to Ne3, since the valve inertial force increases accordingly, the improper movement region gradually widens toward the side where the valve lift is low. It is therefore necessary to prevent improper movement of the valve over the entire rotational speed region of the engine by decreasing the valve lift in response to an increase in the rotational speed of the engine.

In this embodiment, when the rotational speed of the engine exceeds an allowed rotational speed due to a downshift error in a manual transmission, etc., and improper movement of the intake valves 19 is about to occur, the variable valve lift mechanism 33 is operated according to the rotational speed of the engine, and as shown in FIG. 9 the amount of valve lift is thereby reduced without changing the opening angle of the intake valves 19. As a result, the curvature of the valve lift curve at the top decreases, the inertial force applied to the intake valves 19 decreases, and improper movement of the intake valves 19 can be suppressed without specially increasing the set load for the valve springs 24.

In this process, even when the amount of valve lift of the intake valves 19 decreases, since the opening angle does not increase, the intake air volume does not increase and the rotational speed of the engine is prevented from increasing, thus reliably suppressing improper movement of the intake valves 19 and thereby preventing any damage to the valve operating mechanism. Moreover, since the opening angle of the intake valves 19 does not increase, the effectiveness of engine braking is not degraded, and the rotational speed of the engine is decreased by the effective operation of engine braking, thereby preventing improper movement of the intake valves 19.

In this way, since improper movement can be prevented by decreasing the amount of valve lift of the intake valves 19 without specially increasing the load of the valve springs 24, it is unnecessary to increase the dimensions of the valve springs 24 and correspondingly increase the strength of a valve operating mechanism, thereby preventing any increase in the weight and the cost. Moreover, since the amount of valve lift of the intake valves 19 is decreased by a necessary and sufficient amount according to the rotational speed of the engine, improper movement of the intake valves 19 can be reliably suppressed while preventing any rapid change in the output of the engine E. Furthermore, since instead of the opening angle it is only the amount of valve lift that is used as a parameter for changing the curvature at the top of the lift curve of the intake valves 19, the controllability improves.

When the valve lift of the intake valves 19 is changed by making the crank member 68 swing by means of the actuator motor 72, it is necessary to detect the magnitude of the valve lift, that is, the rotational angle of the connecting shaft portion 68*d* of the crank member 68, and use it as feedback for control of the actuator motor 72. For that reason, the rotational angle of the connecting shaft portion 68*d* of the crank member 68 is detected by the rotational angle sensor 85. If simply the rotational angle of the connecting shaft portion 68*d* of the crank member 68 was detected, the rotational angle sensor 85 could be connected directly to the connecting shaft portion 68*d*, but since the intake efficiency changes greatly with only a slight change in the amount of valve lift in the low valve lift region, it is necessary to detect the rotational angle of the connecting shaft portion 68*d* of the crank member 68 precisely and use it as feedback for control of the actuator motor 72. On the other hand, in the high valve lift region since the intake efficiency does not change greatly even when the amount of valve lift changes to some extent, high precision is not required for detection of the rotational angle.

Figure 11:
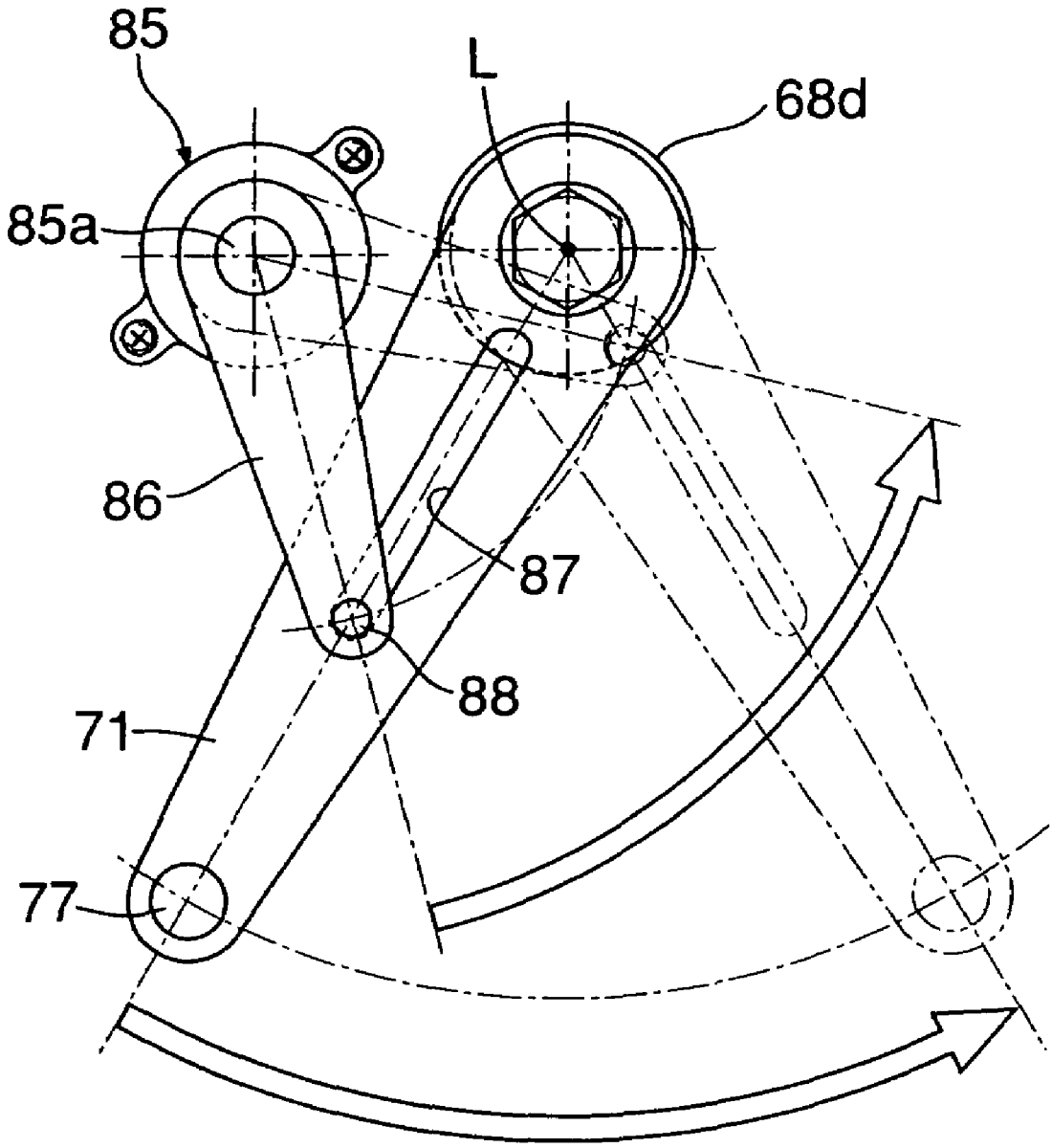

The position of the control arm 71 shown by the solid line in FIG. 11 corresponds to the low valve lift region, and the position of the control arm 71 shown by the region that is in the anticlockwise direction from the low valve lift region corresponds to the high valve lift position. In the low valve lift region, since the pin 88 of the sensor arm 86 fixed to the sensor shaft 85*a* of the rotational angle sensor 85 engages with the tip side (the side distant from the axis L) of the guide channel 87 of the control arm 71, when the control arm 71 swings even slightly, the sensor arm 86 swings to a large extent. That is, the ratio of the rotational angle of the sensor shaft 85*a* relative to the rotational angle of the crank member 68 increases, the resolution of the rotational angle sensor 85 is enhanced, and the rotational angle of the crank member 68 can be detected with high precision.

On the other hand, in the high valve lift region where the control arm 71 has swung to the position shown by the broken line, since the pin of the sensor arm 86 fixed to the sensor shaft 85*a* of the rotational angle sensor 85 engages with the base side (the side close to the axis L) of the guide channel 87 of the control arm 71, even when the control arm 71 swings to a great extent, the sensor arm 86 swings only slightly. That is, the ratio of the rotational angle of the sensor shaft 85*a* relative to the rotational angle of the crank member 68 is small, and the precision of detection of the rotational angle of the crank member 68 is low compared with that obtained at a low valve lift.

Figure 12:
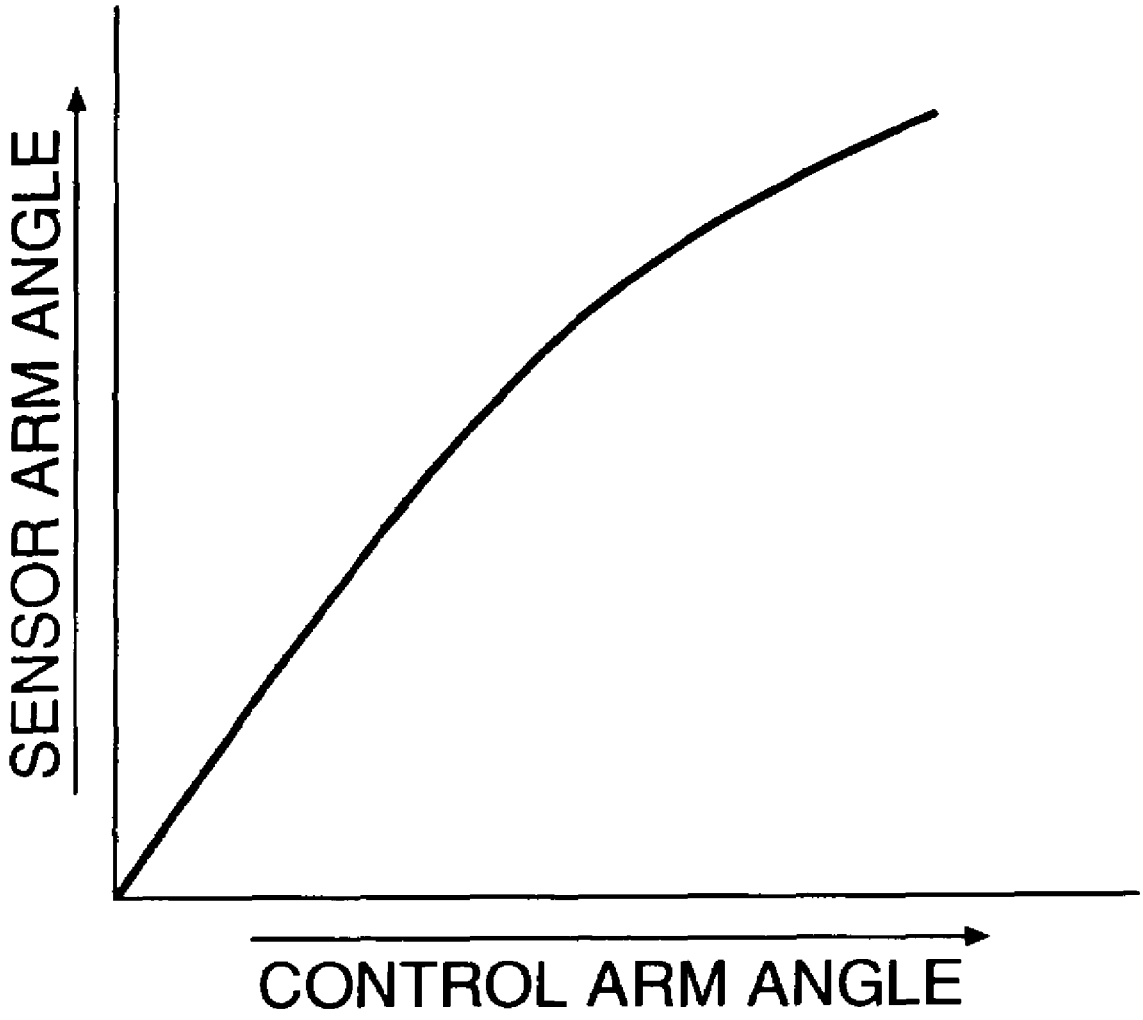

As is clear from FIG. 12, when the rotational angle of the control arm 71 increases from a low valve lift state to a high valve lift state, the detection precision is high at first since the rate of increase of the angle of the sensor arm 86 is high, but the rate of increase gradually decreases and the detection precision becomes low.

In this way, by engaging the sensor arm 86 of the rotational angle sensor 85 with the guide channel 87 of the control arm 71, detection precision is obtained in a low valve lift state where a high detection precision is required without using an expensive high precision rotational angle sensor 85, thereby contributing to a reduction in cost.

In this arrangement, since one end (that close to the connecting shaft portion 68*d*) of the control arm 71 and one end (that far from the rotational angle sensor 85) of the sensor arm 86 are arranged in proximity, and the guide channel 87 is formed in the one end of the control arm 71, the length of the sensor arm 86 can be shortened, thus making it compact. When the guide channel 87 is formed in the one end of the control arm 71, although the distance from the axis L becomes small and the amount of travel in the circumferential direction of the guide channel 87 is small, since the length of the sensor arm 86 is short, it is possible to ensure a sufficient rotational angle of the sensor arm 86, thereby ensuring the precision of detection of the rotational angle sensor 85.

Figure 13:
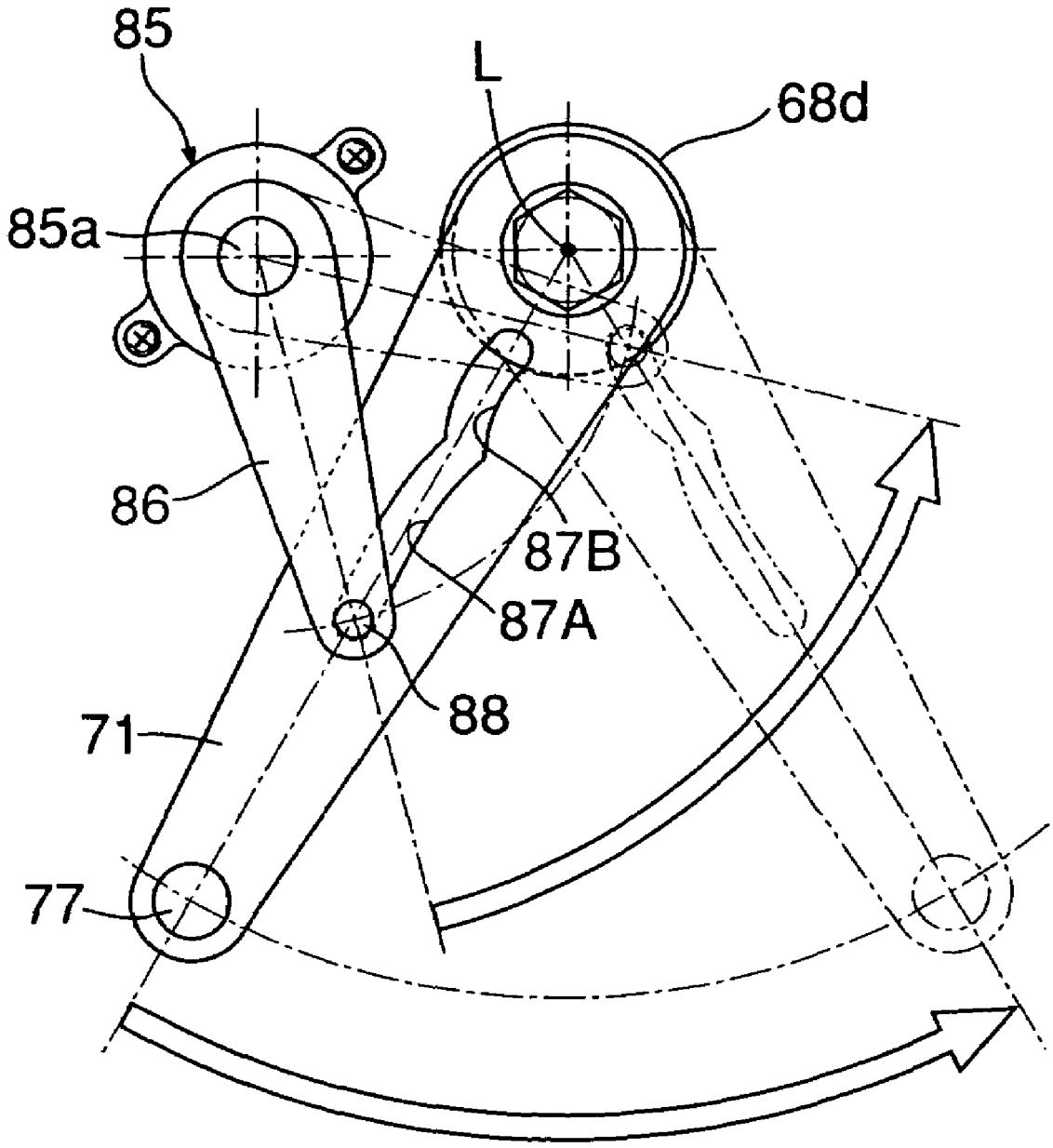
FIG. 13 and FIG. 14 illustrate a second embodiment of the present invention.
Figure 14:
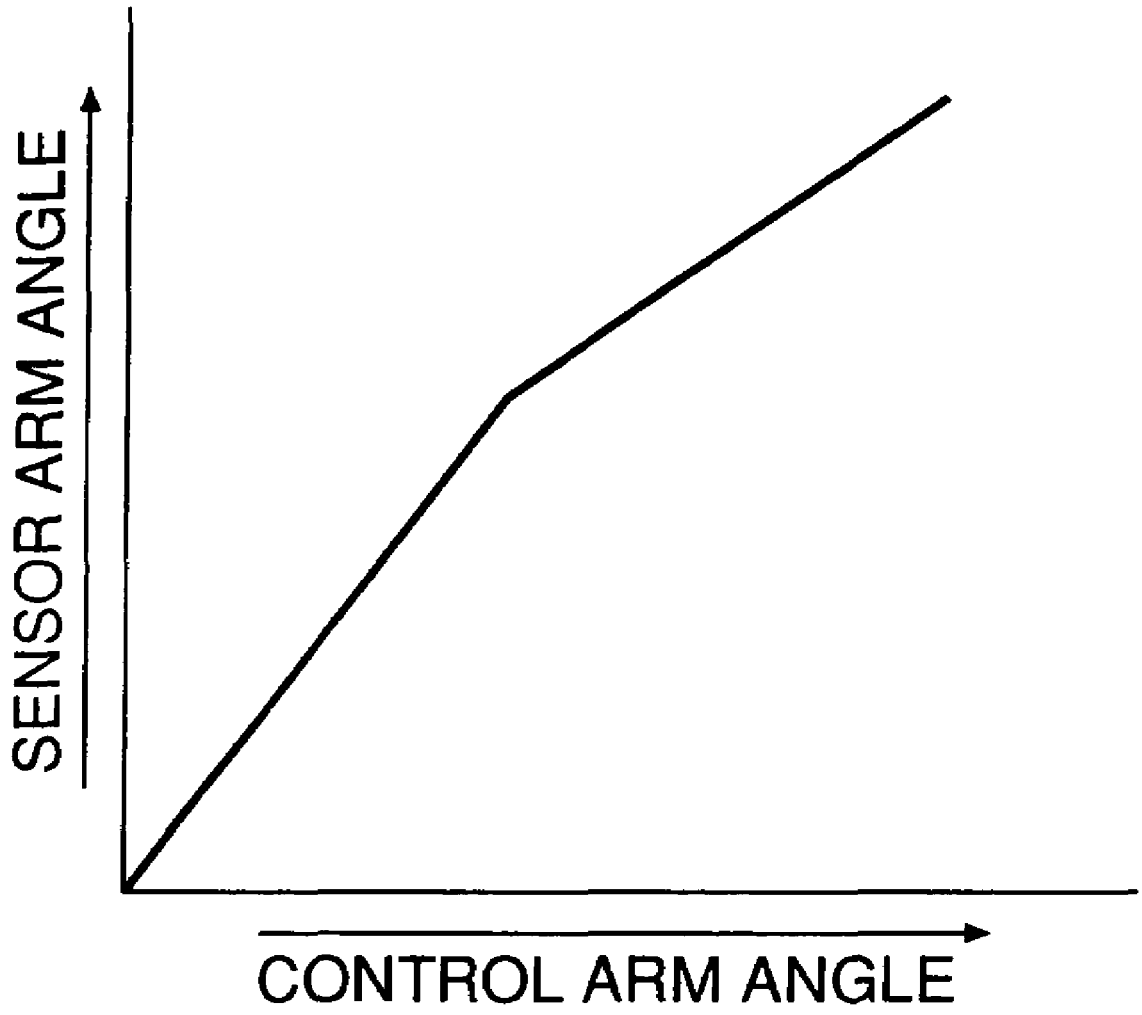

A second embodiment of the present invention is now explained with reference to FIG. 13 and FIG. 14. Whereas the guide channel 87 of the first embodiment is formed linearly along the longitudinal direction of the control arm 71, in the second embodiment, a guide channel 87B in one end of the control arm 71 and a guide channel 87A for a low valve lift in the other end of the control arm 71 are formed into different arc shapes. As a result, as shown in FIG. 14, it is possible to impart a characteristic such that, as the rotational angle of the control arm 71 increases from a low valve lift state to a high valve lift state, the rotational angle of the sensor arm 86 changes with a point of inflection. In this way, by changing the shape of the guide channels 87, 87A, and 87B of the control arm 71 it is possible to freely determine the characteristics of the change in the rotational angle of the sensor arm 86.

Although embodiments of the present invention are described above, the present invention is not limited to the above-mentioned embodiments and can be modified in a variety of ways without departing from the scope and the spirit of the present invention described in the claims.

For example, in the above-mentioned embodiments, the variable valve lift mechanism 33 is applied only to the intake valves 19, but it can be applied only to the exhaust valves 20, or to both the intake valves 19 and the exhaust valves 20.

The invention claimed is:

1. An engine valve operating system comprising a variable valve lift mechanism that varies the amount of lift of a valve, the variable valve lift mechanism decreasing the amount of lift of the valve in a region where improper movement of the valve occurs due to an increase in the rotational speed of the engine, so that the curvature at the top of a lift curve of the valve becomes a curvature at which the improper movement does not occur;

wherein, when the improper movement occurs, the variable valve lift mechanism decreases, according to the rotational speed of the engine, the amount of lift down to a value at which occurrence of the improper movement can be suppressed.

2. The engine valve operating system according to claim 1, wherein the variable valve lift mechanism varies the amount of lift without changing the opening angle of the valve.

3. The engine valve operating system according to claim 1, wherein the variable valve lift mechanism comprises a member having a movement corresponding to the amount of lift of the valve, and a sensor that is operatively associated with the member, wherein the sensor has a motion, due to the movement of the member corresponding to the amount of lift of the valve, which is higher in precision in a low valve lift region than in a high valve lift region.

4. The engine valve operating system according to claim 3, wherein the member comprises a crank member including a shaft, which is rotatable between a first position of the low valve lift region and a second position of the high valve lift region, and wherein the crank member includes a control arm which is rotatable integrally with the shaft, the sensor being connected to the control arm at a control-arm position of the control arm which is movable in response to a rotation of the control arm between the first and second positions.

5. The engine valve operating system according to claim 4, wherein the sensor has a portion thereof, connected to the control arm, being slidable along a guide channel formed in the control arm generally slang a lengthwise direction of the control arm.

6. The engine valve operating system according to claim 5, wherein the guide channel is of a straight form.

7. The engine valve operating system according to claim 5, wherein the guide channel is of a non-straight form.

8. The engine valve operating system according to claim 4, wherein the precision increases as a ratio increases, wherein the ratio is a ratio of a rotational angle of the sensor relative to a rotational angle of the crank member.

9. The engine valve operating system according to claim 4, wherein, in response to the rotation of the control arm between the first and second positions, the sensor rotates and the control-arm position moves along the control arm.

* * * * *